US007106002B1

(12) United States Patent
Lang et al.

(10) Patent No.: US 7,106,002 B1
(45) Date of Patent: Sep. 12, 2006

(54) LIGHT BULB WITH GLASS ENVELOPE HAVING LIGHT TRANSMISSION OF A WAVELENGTH ONLY UP TO 700 NM

(75) Inventors: William Joseph Lang, Bonsall; Ralph E. Johnson, Los Alamitos; John B. Hartley, Pacific Palisades, all of CA (US)

(73) Assignee: Illumination Technology, Inc., Cypress, CA (US)

( * ) Notice: Subject to any disclaimer, the term of this patent is extended or adjusted under 35 U.S.C. 154(b) by 0 days.

(21) Appl. No.: 08/896,990

(22) Filed: Jul. 18, 1997

Related U.S. Application Data

(63) Continuation of application No. 08/400,990, filed on Mar. 8, 1995, now Pat. No. 5,686,786.

(51) Int. Cl.
*H01K 1/50* (2006.01)

(52) U.S. Cl. ..... 313/578; 313/493; 313/634; 313/579

(58) Field of Classification Search ..... 313/578, 313/493, 634, 580, 579, 636
See application file for complete search history.

(56) References Cited

U.S. PATENT DOCUMENTS 5,539,628 A 7/1996 Seib ..... 362/255
5,686,786 A * 11/1997 Lang et al. ..... 313/478

FOREIGN PATENT DOCUMENTS

EP 0213928 3/1998

* cited by examiner

*Primary Examiner*—Vip Patel
(74) *Attorney, Agent, or Firm*—Klein & Szekers, LLP

(57) ABSTRACT

A light bulb that is with glass envelope having light transmission of a wavelength only up to 700 nm has an incandescent filament enclosed in a glass envelope that transmits substantially no detectable amount of light of a wave length greater than 700 nanometers.

10 Claims, 5 Drawing Sheets

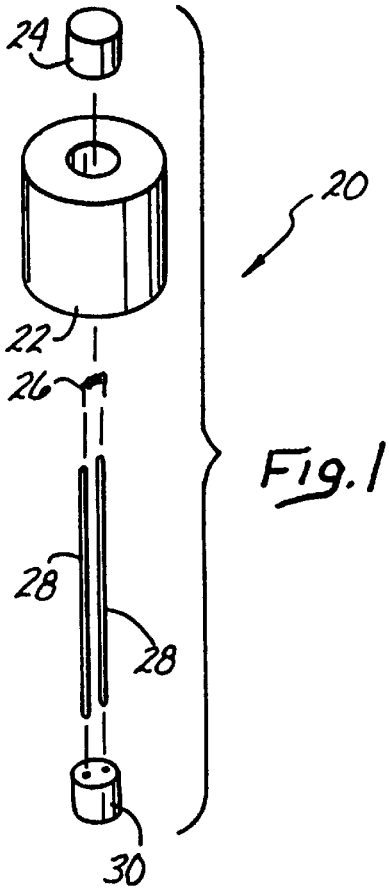
Fig. 1
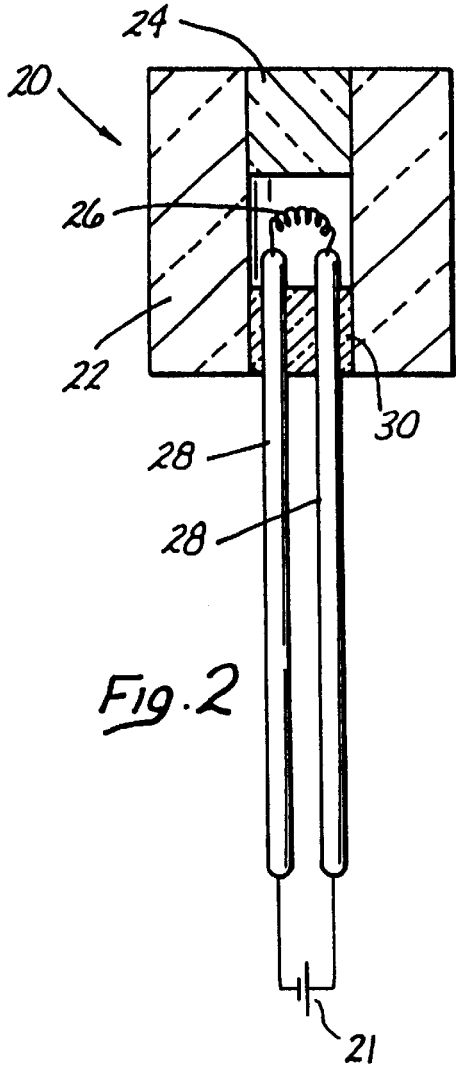
Fig. 2
Fig. 4
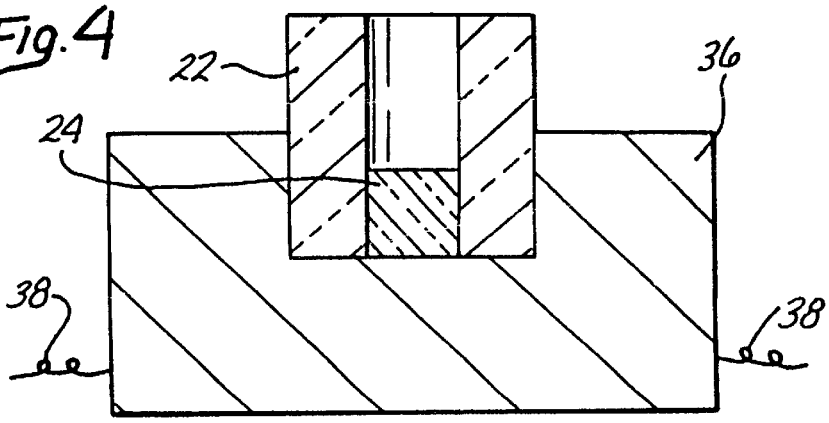

LIGHT BULB WITH GLASS ENVELOPE HAVING LIGHT TRANSMISSION OF A WAVELENGTH ONLY UP TO 700 NM

CROSS-REFERENCE TO RELATED APPLICATION

The present application is a continuation of application Ser. No. 08/400,990, filed on Mar. 8, 1995, to be issued as U.S. Pat. No. 5,686,786.

BACKGROUND OF THE INVENTION

1. Field of the Invention

The present invention is in the field of incandescent lamps. More particularly, the present invention is in the field of incandescent lamps or light bulbs which are used in conjunction with night vision equipment.

2. Brief Description of the Prior Art

Night vision equipment used for military or like purposes electronically enhances infra red (ir) radiation to form images which are viewed by military or like personnel. Frequently, if not most commonly, personnel who use night vision equipment are occupying vehicles or aircraft. However, normal or regular incandescent light bulbs utilized for illuminating instrument panels or the like of vehicles and aircraft are not compatible with the use of night vision equipment. This is because normal or regular incandescent light bulbs emit substantial radiation in the infra red range. Consequently, if the infra red output of ordinary instrument panel light bulbs were amplified by the night vision equipment an image of such brightness would be produced which would be likely to cause eye injury to the personnel using the night vision equipment. Infra red radiation output of ordinary incandescent light bulbs used in the instrument panels of vehicles and aircraft, could also be detected by the night vision equipment of an adversary. The prior art has attempted to solve the foregoing problems in applications requiring the use of night vision equipment by interposing a filter between the light bulb and the personnel so as to substantially filter out the light of undesirable wave length of the ordinary incandescent light bulbs of instrument panels and the like. The filter of the prior art is located externally to the light bulb, and as such it forms an additional component or part of the equipment which must be obtained and installed into the vehicle or aircraft. The present invention provides a better solution to the foregoing problems.

SUMMARY OF THE INVENTION

It is an object of the present invention to provide an incandescent lamp or bulb which emits a spectrum of radiation that is compatible, without the use of external filters, with the use of night vision equipment.

It is another object of the present invention to provide an incandescent lamp or bulb which meets the foregoing objective, and which is relatively inexpensive to manufacture and convenient to install and use.

The foregoing and other objects and advantages are attained by an incandescent light bulb which has an incandescent filament in metal-to-metal contact with pins which are sealed with glass-to-metal seal in an opaque glass bead. The glass bead is sealed in a colored glass envelope that transmits light energy substantially only in that portion of the spectrum which is not detected by night vision equipment. Electrical energy to energize the filaments can be transmitted to the lamp through the pins which protrude externally from the bead.

The features of the present invention can be best understood together with further objects and advantages by reference to the following description, taken in connection with the accompanying drawings, wherein like numerals indicate like parts.

BRIEF DESCRIPTION OF THE DRAWINGS

FIG. 1 is an exploded view of the first preferred embodiment of the incandescent light bulb of the present invention;

FIG. 2 is a cross-sectional view of the first preferred embodiment;

FIG. 4 is a schematic cross-sectional view showing a step in the preferred method of manufacturing a sub-assembly of the first preferred embodiment;

DESCRIPTION OF THE PREFERRED EMBODIMENTS

The following specification taken in conjunction with the drawings sets forth the preferred embodiments of the present invention. The embodiments of the invention disclosed herein are the best modes contemplated by the inventors for carrying out their invention, although it should be understood that various modifications can be accomplished within the parameters of the present invention.

Referring now to FIGS. 1–5, and particularly to the exploded view of FIG. 1 of the appended drawings, a first preferred embodiment 20 of the incandescent light bulb of the present invention is disclosed. As it is noted briefly in the introductory sections of the present application for patent, the light bulb of the present invention is intended for use in conjunction with night vision equipment. As such, the light bulb of the invention emits a spectrum of energy which is of such nature that it satisfies the requirements of the users of night vision equipment, that is, the light bulb or lamp of the present invention emits no substantial or significant amount of energy in that range of the electromagnetic spectrum which would be amplified by state-of-the-art night vision equipment to appear as a significant signal thereon. The acceptable range of emission of light waves and infra red waves, (hereinafter when applicable collectively called as "light") for use in conjunction with state-of-the-art night vision equipment is presently defined, at least in the United States of America, by military specification. Generally speaking, lack of infra red emission which is acceptable for use in conjunction with state-of-the-art night vision equipment means no measurable light emission above 700 nanometers (nm). Speaking still in general terms, green light, green-blue light or amber light with no substantial component above 700 nm is usually preferred for use in conjunction with night vision equipment, with green light presently being preferred in accordance with the present invention. Those skilled in the art will understand that glass which transmits light of the above-described color is either colloidically or ionically colored.

Figure 12:
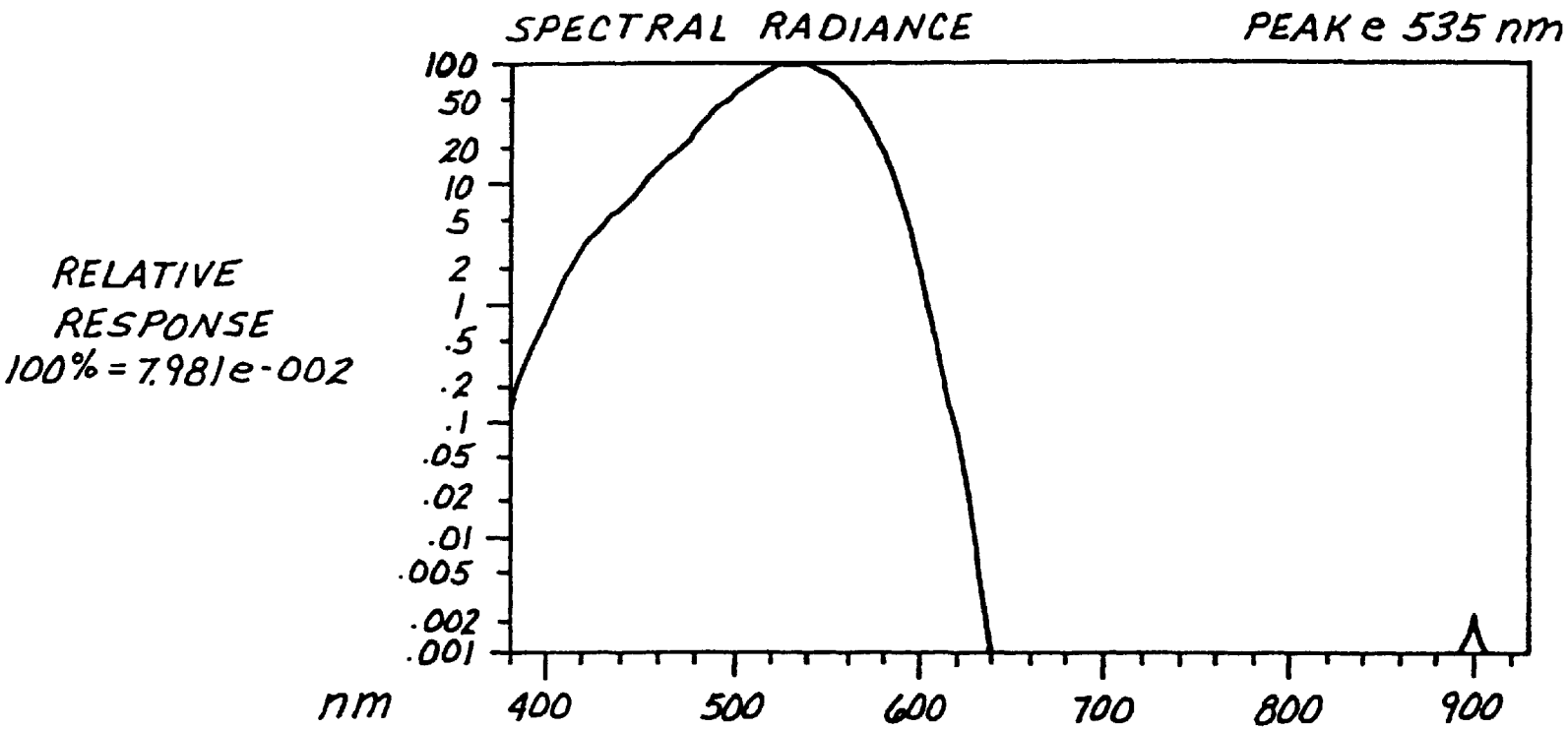
FIG. 12 is a graph showing the "spectral radiance" of the glass envelope which is used in the preferred embodiments of the incandescent light bulbs of the present invention.

FIG. 12 of the appended drawings shows the "spectral radiance" curve of the colored glass envelope which is used in the preferred embodiments of the present invention, and Table 1 below lists further characteristics of this glass, which is commercially available as Schott S-8022 NVIS glass. As it can be seen, this glass has no detectable transmission of light above approximately 640 nm, the peak of transmission being in the range of 530 to 550 nm, with the actual maximum being at 535 nm. It should be understood however that glasses of different specific transmission characteristics are available in the art which still satisfy the principal requirement of the present invention, namely no measurable light transmission above 700 nm.

TABLE 1

| NVIS LIMINANCE | LUMINANCE | C.I.E. | HEAD PARAMETERS |
|---|---|---|---|
| 1.000e-001 fL | 7.954e + 002 | x = 0.2182 | AC: MS-80 |
| .426e-001 Cd/n2 | 2.725e + 003 | y = 0.5887 | FF: ND-2 |
| NVIS-A RADIANCE | NR LIMIT | u' = 0.0907 | RF: OPEN |
| 4.614e-001 | 1.700e-010 | v' = 0.5503 | AP: 1 degree |
| NR (450–930 nm) | NR | v = 0.3669 | BW: 10 nm. |

| IDENTIFICATION | Menu | IDENTIFICATION DESCRIPTION | | | |
|---|---|---|---|---|---|
| PR-1980C/NVG | Dump | I: NVIS FILTER FRONT | | | |
| S/N :T-2702 | Zoom | P: wavelength U: nm | | | |
| Ver. X1791 | Pan | L. | LOWER | UPPER | INCR. |
| Wed 02/16/94 | Solid | B. | 380 | 930 | 5 |
| TIME 09:17:24 | To Main | | | | |

| | |
|---|---|
| NVIS CLASS | : A |
| NVIS GREEN A | : PASS |
| NVIS GREEN B | : |
| NVIS YELLOW | : |
| NVIS RED | : |
| NVIS RADIANCE | : PASS |
| NL SCALING: 1.257e-004 | |

The light bulb or lamp of the present invention is primarily designed and used in instrument panels and like applications. For this reason, the preferred embodiments operate on a 5V power source. However, it should be understood that incandescent lamps or light bulbs can be constructed in accordance with the present invention which operate on a higher or lower voltage, such as 28 volts. The power source is schematically shown in FIG. 2 with the reference numeral 21.

Referring now principally to FIGS. 1 and 2, the first preferred embodiment 20 of the incandescent lamp of the present invention has a cylindrically shaped envelope 22 which is made from the above described Schott S-8022 NVIS glass. Whereas those skilled in the art will readily understand that the dimensions of the lamp are not critical, nevertheless by way of example it is noted that the cylindrical envelope 22 has an outer diameter of 0.245", and a wall that is of 2.0 milimiter (mm) thickness. The envelope 22 of this preferred embodiment is 0.237" long. A glass rod 24, which is preferably made from the same glass as the cylindrical envelope 22 is disposed in the upper opening of the cylindrical envelope 22, and seals the same. The glass rod 24 of the first preferred embodiment is 2 mm long.

The incandescent filament 26 of the light bulb of the invention is mounted to a pair of pins 28 which are sealed with glass-to-metal seal in a bead 30 that closes the bottom opening of the cylindrical envelope 22. The filament 26 itself is of conventional construction. In the preferred embodiment it is made of tungsten alloyed with approximately 3% rhenium. The filament 26 of the first preferred embodiment is approximately 0.909" long in uncoiled configuration, has a diameter of 20 microns; and when energized with a 5 Volt source the lamp is designed to draw 0.115 amp of current. Actual length of the helically coiled filament 26 including its coiled portion is approximately 0.117". The pins 28 to which the filament 26 is attached, are made from an alloy known under the tradename DUMET®; this is an alloy having a nickel-iron core and a copper sheath. A principal characteristic of this alloy is that it has substantially the same coefficient of thermal expansion as glass, so that it can be sealed hermetically into glass with a glass-to-metal seal. The material of the filament 26 is substantially harder than the copper sheath of the pins 28 so that the filament 26 is attached to the pins 28 by impacting or pushing the ends of the filament 26 into the respecting pins 28. This technique per se is not novel, and is known in the art as "staking". The pins 28 of the first preferred embodiment have a diameter of approximately 0.020" and are approximately 0.5" long.

Each pin 28 is sealed by glass-to-metal seal in an axially aligned hole formed in the cylindrical bead 30 that closes the bottom opening of the cylindrical envelope 22. The bead 30 of the first preferred embodiment is made from glass which is substantially non-transparent to light and which in the preferred embodiment comprises black or opaque Schott 8350 glass. Examples of other commercially available glasses for this purpose are Corning 0080, and Kimble R-6. As it can be seen from the cross-sectional view of FIG. 2, the pins 28 protrude substantially from the non-transparent (opaque) bead 30 and as such are suitable for mounting the lamp 20 into an instrument panel (not shown) in conventional manner. In the herein described first preferred embodiment 20 the pins 28 protrude 0.637 inches from the lamp 20.

As it should be apparent from the foregoing description, the light bulb 20 of the preferred embodiment of the present invention emits light substantially in accordance with the spectral characteristics shown in FIG. 12 and particularly described in Table 1, and is consequently usable in conjunction with night vision equipment. The light bulb 20 can be mounted into equipment (not shown), such as the instrument panels of vehicles and aircraft, without the use of any filter.

Figure 3:
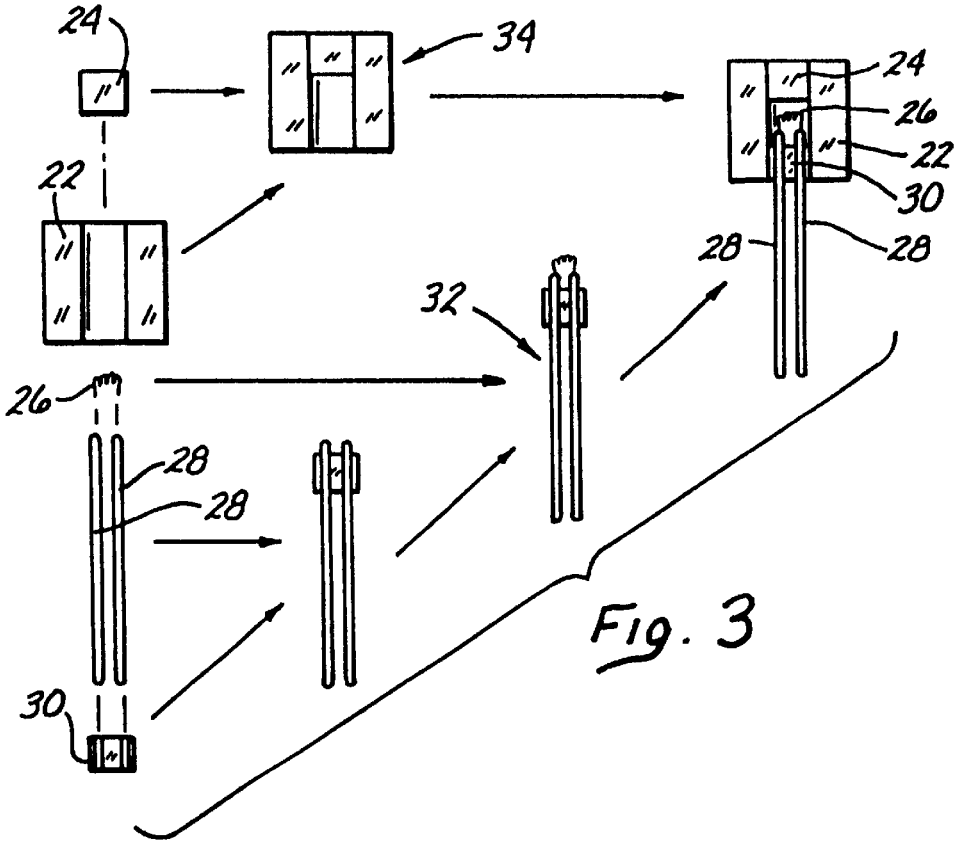
FIG. 3 is a diagram schematically showing a preferred method of manufacturing the first preferred embodiment.

Referring now to FIG. 3, the process of manufacturing the light bulb 20 of the first preferred embodiment is illustrated. In accordance with this manufacturing process the pins 28 are first sealed in the bead 30, and thereafter the filament 26 is attached to the pins 28 by staking, as described above, resulting in a filament-to-pin-to-bead subassembly 32. In a separate sealing process the glass rod 24 is sealed to the cylindrical glass envelope 22, resulting in a cylinder-to-rod subassembly 34. In still another step of sealing, the subassembly 32 is heat sealed to the cylinder-to-rod subassembly 34 to provide the light bulb 20. During the latter step of sealing the interior of the lamp 20 is evacuated and vacuum is retained within the interior of the lamp 20.

It has been found in accordance with the present invention that good results are obtained when each of the steps of sealing of the several components to one another, as described above, are performed in a vacuum furnace (not shown) by applying, heat, vacuum, and an inert gas in a sequence which is explained below for each sealing step performed in connection with manufacturing the first preferred embodiment. Although the nature of the vacuum furnace (not shown) and of associated equipment is known in the art, to better explain the sealing process it is briefly described here as follows.

The vacuum furnace (not shown) is operatively connected to and is controled by a programmable computer (not shown). More specifically, the computer controls various electrically operated valves and a heating system connected to the vacuum furnace. The vacuum furnace is connected to a vacuum pump that during operation of the furnace runs all the time. An electrically operated valve, under control of the computer, connects the pump to the furnace. When connected to the furnace for a sufficiently long time to reach "equilibrium", an absolute pressure of approximately $10^{-5}$ atmosphere is attained in the furnace. In addition the furnace is connected to two pressure regulated gas sources, with suitable electrically operated valves, under the control of the computer, capable of allowing gas to enter into the furnace when desired. The vacuum furnace also has a valved (under control of the computer) vent connection to the ambient environment. Objects placed into the vacuum furnace can be heated in a closed loop heating system. The temperature can be "lineraly ramped" between an instant temperature and the desired temperature, and the a desired temperature can be maintained for a desired time period.

Figure 5:
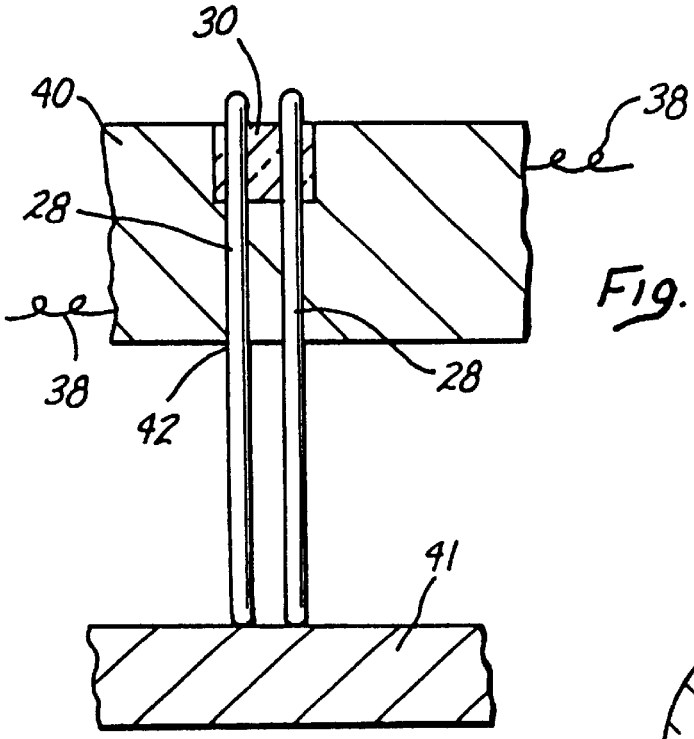
FIG. 5 is a schematic cross-sectional view showing a step in the preferred method of manufacturing another sub-assembly of the first preferred embodiment.
Figure 6:
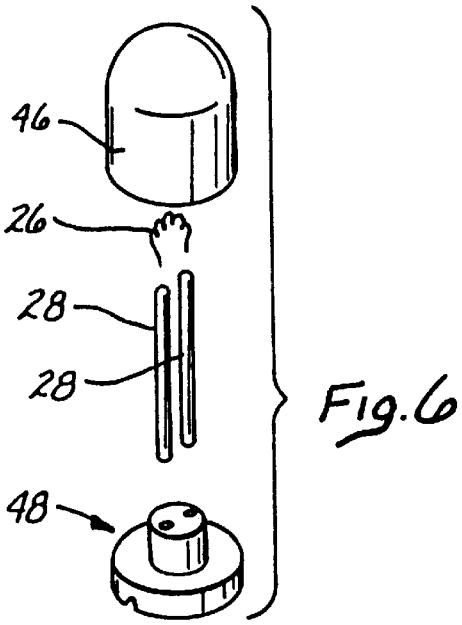
FIG. 6 is an exploded view of the second preferred embodiment of the incandescent light bulb of the present invention.
Figure 7:
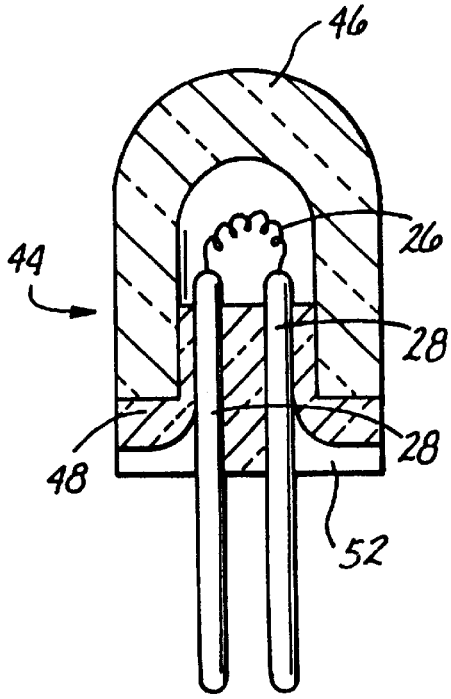
FIG. 7 is a cross-sectional view of the second preferred embodiment.

In the presently preferred process of manufacturing the present invention, heat is applied to the components and subassemblies to be sealed to one another, by applying current to a graffite boat 36 in which the components or subassemblies to be sealed are mounted. FIG. 4 schematically shows a portion of the graffite boat 36. Although only one is shown on the figure, the boat 36 has a plurality of holes dimensioned to accept the appropriate components, in this instance the cylindrical envelope 22 and the rod 24. Thus, the foregoing components are placed into the boat 36 and the charged boat is then placed into the vacuum firnace (not shown) where the sealing process is performed. The wires 38 attached to the boat schematically illustrate that the boat 36 is heated by applying current. FIG. 5 illustrates a portion of a graffite boat 40 and a spaced stop plate 41, in which the pins 28 are sealed to the bead 30. As it can be seen, in this boat 40 holes 42 are placed into the bottom to accommodate the pins 28 and the stop plate 41 keeps the pins 28 in the correct position relative to the bead 30.

Sealing of the cylinder-to-rod subassembly 34

The process of sealing the rod 24 to the cylindrical envelope 22 to obtain the cylinder-to-rod subassembly 34 is preferably performed in the above described vacuum furnace and associated equipment in the following steps and sequence.

1. From the beginning of the sealing cycle:
   a. The vacuum valve is opened for 10 seconds. This pulls a partial vacuum.
   b. The temperature of the sealing tool is linearly ramped to 24 degrees C. above the glass softening point over a 4.5 minute time period. This heats the glass components slowly to prevent cracking.
2. At 4.5 minutes into the sealing cycle:
   a. The vacuum valve is opened for 2.1 minutes. This allows the chamber to reach approx. 1/10,000 of an atmosphere pressure.
   b. After 2 additional minutes nitrogen is injected for 3 second. This gas injection allows convection heating of the glass components.
3. After 12.5 minutes into the sealing cycle:
   a. The heater is turned off.
   b. After 2.5 additional minutes nitrogen is injected for 10 seconds. This is to start cooling the components.
   c. After 8.5 additional minutes the chamber is vented to the atmosphere for 5 seconds.

Sealing of the pin-to-bead subassembly 32

The process of sealing the metal pins 28 to the opaque bead 30 to obtain the pin-to-bead subassembly 32 is preferably performed in the above described vacuum furnace and associated equipment in the following steps and sequence.

1. From the beginning of the sealing cycle:
   a. The vacuum valve is opened for 10 seconds. This pulls a partial vacuum.
   b. The temperature of the sealing tool is linearly ramped to 54 degrees C. above the glass softening point over a 3.5 minute time period. A partial pressure of approximately 1/10 of an atmosphere of the ambient environment is present inside the chamber during this time to form an oxide on the copper surface of the pins to aid in the glass to metal seal.
2. At 3.5 minutes into the sealing cycle:
   a. The vacuum valve is opened for 2.4 minutes. This step in the sealing cycle allows the chamber to reach a pressure of 1/10,000 of an atmosphere.
   b. After 2 additional minutes nitrogen is injected for 14 seconds. This gas injection allows convective heating of the glass components.
3. After 11.5 minutes into the sealing cycle:
   a. The chamber temperature is linearly ramped to 24 degrees C. above the glass softening point over a 1 minute time period.
   b. After 1.15 additional minutes $N_2H_2$ is injected for 15 seconds. This gas is used to clean the oxide off of the Dumet surfaces outside the glass to metal seal.
   c. After 2.15 additional minutes the chamber is vented to the atmosphere for 5 seconds. This occurs during step "c".
4. After 13 minutes into the sealing cycle:
   a. $N_2H_2$ is injected for 12 seconds. Once again, this gas is used to clean the oxide off of the Dumet surfaces outside the glass to metal seal.
   b. After 2 additional seconds the chamber is vented to the atmosphere for 5 seconds. This occurs during step "a".
   c. After 10 additional seconds the heater is turned off.
5. After 18.8 minutes into the sealing cycle:
   a. The chamber is vented to the atmosphere for 2 seconds.

Sealing of the cylinder-to-rod subassembly 34 to the pin-to-bead subassembly 32

The final sealing process of the manufacturing operation is sealing the cylinder-to-rod subassembly 34 to the pin-to-bead subassembly 32. This is preferably performed in the above described vacuum furnace and associated equipment in the following steps and sequence.

1. From the beginning of the sealing cycle:
   a. The vacuum valve is opened for 1 minute. This pulls a partial vacuum.
   b. The temperature of the sealing tool is linearly ramped to 43 degrees C. above the glass softening point over a 4 minute time period. This heats the glass components slowly to prevent cracking.
2. At 4 minutes into the sealing cycle:
   a. The vacuum valve is opened for 7 minutes. This allows the chamber to reach approx. 1/10,000 of an atmosphere pressure.
3. After 13 minutes into the sealing cycle:
   a. The heater is turned off.
   b. Nitrogen is injected for 1 second. This causes the seal to clamp closed.
   c. After 2 additional minutes Nitrogen is injected for 10 seconds. This is to start cooling the components.

d. After 3.5 additional minutes the chamber is vented to the atmosphere for 10 seconds.

FIGS. 6–11 disclose a second preferred embodiment 44 of the light bulb of the present invention. This embodiment comprises a dome shaped envelope 46 which is made of KOPP K0503 NVIS glass. The dome-shaped envelope 46 can also be made of several other commercially available brands of glass which satisfy the requirement that they do not transmit measurable amount of light of a wave length above approximately 700 nm, thereby being compatible with the use of night vision equipment, as discussed above. In the presently described second preferred embodiment the envelope 46 is of 0.185" diameter, has a wall that is approximately 1 mm thick, and the diameter of the internal opening is 0.100". The height of the envelope is 0.185". The opening in the dome-shaped envelope 46 is closed with an opaque bead 48 of Schott 8350 glass, into which the filament 26 bearing pins 28 are mounted, substantially as described in connection with the first preferred embodiment.

Figure 8:
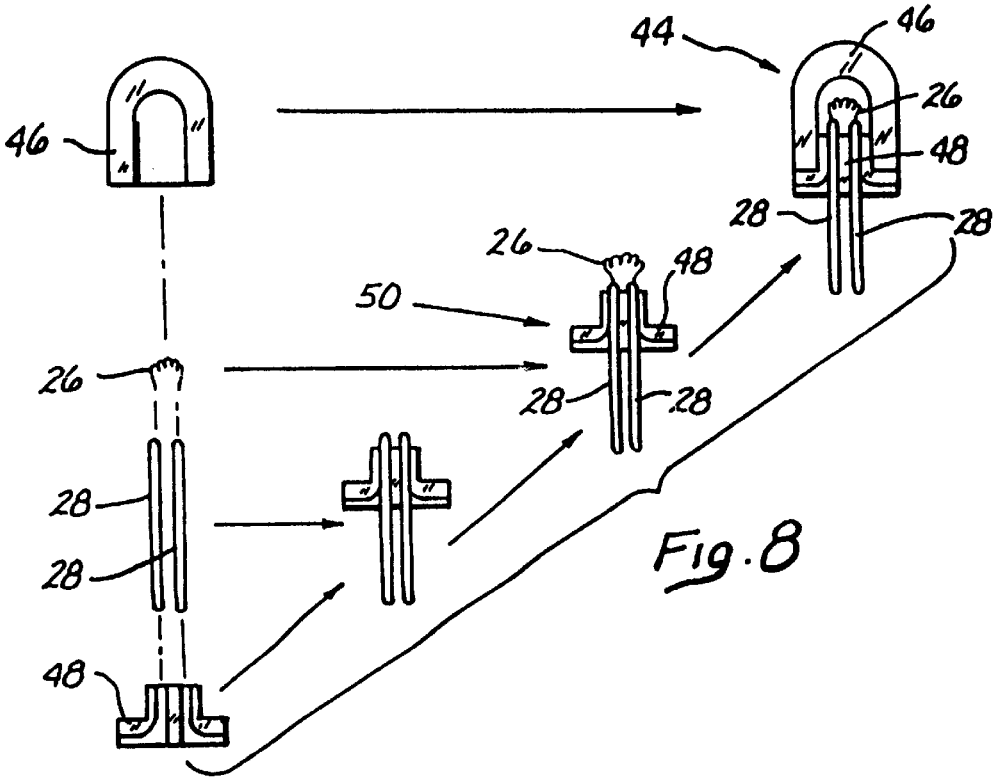
FIG. 8 is a diagram schematically showing a preferred method of manufacturing the second preferred embodiment.

FIG. 8 illustrates the steps of the preferred method of manufacturing the second preferred embodiment 44. In accordance with this process, the filament-to-pin-to-bead subassembly 50 is made, substantially as described in connection with FIG. 3, and thereafter the subassembly 50 is sealed to the dome-shaped envelope 46.

Figure 9:
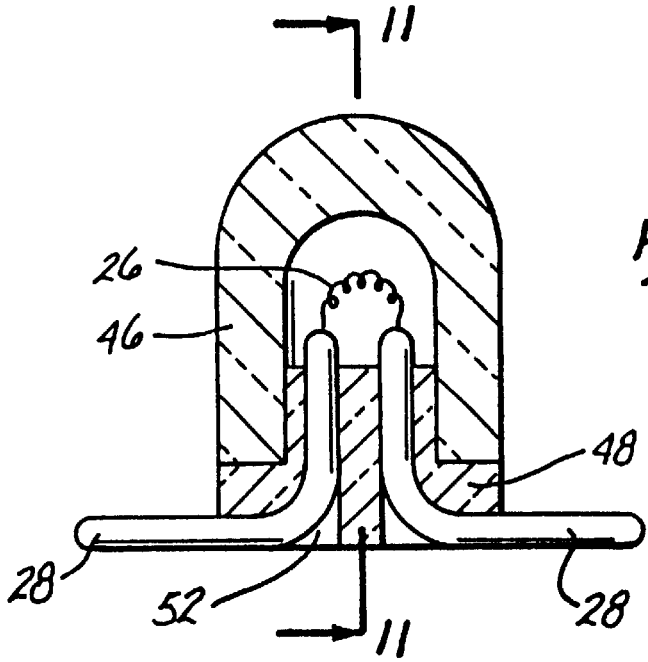
FIG. 9 is a cross-sectional view of the second preferred embodiment, showing the electrical contact pins of the bulb being bent outwardly and flush with the bottom surface of the bulb.
Figure 10:
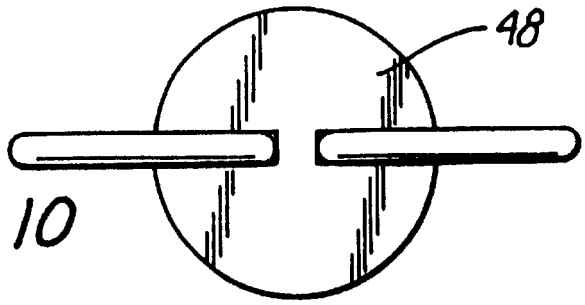
FIG. 10 is a bottom view of the second preferred embodiment shown in FIG. 9.
Figure 11:
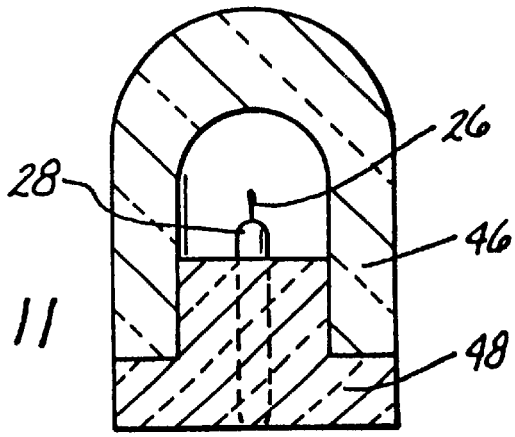
FIG. 11 is a side view of the second preferred embodiment shown in FIG. 9.

FIGS. 9, 10 and 11 illustrate yet another important feature of the light bulb of the second preferred embodiment 44. A groove or slot 52 of dimensions capable of accomodating the pins 28 is disposed in the bottom of the bead 48. The bead 48 itself comprises two concentrically disposed cylindrical bodies the narrower of which fits into the opening in the envelope 46. The wider cylindrical body substantially matches the outer diameter of the envelope 46. Consequently, when the pins 28 are bent outwardly, as shown in FIGS. 9 through 11, they are disposed within the grooves 52 and are flush with the bottom surface 54 of the recessed bead 48. This facilitates the mounting of the second embodiment 44 on a support surface (not shown).

To the best knowledge of the present inventors the light bulb of the second preferred embodiment 44 having the recessed bead 48 and grooves 52 in its bottom is unknown in the prior art even when the dome shaped envelope 46 is made of ordinary glass that is not suitable for use in conjunction with night vision equipment. Such a light bulb is nevertheless advantageous because it can be readily mounted to a flat support surface with the pins bent outwardly for convenient connection (for example by soldering) to power supply wires (not shown).

What has been described above is an incandescent lamp that emits no significant amount of light of a wave length greater than approximately 700 nm, and is therefore suitable for use in conjunction with night vision equipment without the use of filters. Another feauture descibed above is light bulb that is readily mountable to a flat surface. Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. An incandescent lamp suitable for use in conjunction with night vision equipment, the lamp comprising:

a substantially dome-shaped glass envelope that transmits substantially no light energy of a wavelength greater than approximately 700 nanometers, the glass envelope having a single opening;

a filament mounted within the interior of the glass envelope;

a pair of metal contact pins supporting the filament and in electrical contact therewith, the pins being disposed partially enclosed within the envelope and partially outside of the envelope whereby the lamp can be energized through contacting the pins with a voltage source, and a glass bead that transmits substantially no light at any wavelength, dimensioned to fit into the opening of the glass envelope and heat-sealed therein to hermetically close-off the same, the pins penetrating through the glass bead being heat-sealed thereinto.

2. The incandescent lamp of claim 1 wherein the bead comprises two integrally constructed concentrical cylinders, the first of said two cylinders being narrower than the second cylinder and disposed in the opening of the glass envelope, the second cylinder having a bottom surface and a groove formed in the bottom surface, said groove being dimensioned to accomodate the pins substantially flush with the bottom surface when said pins are bent outwardly, substantially at right angle to the longitudinal axis of the lamp.

3. The incandescent lamp of claim of claim 2 wherein the peak of transmission of light by the glass envelope is in the range of 530 to 550 nanometers.

4. The incandescent lamp of claim 3 wherein the peak of transmission of light by the glass envelope is approximately 535 nanometers.

5. The incandescent lamp of claim 2 wherein the pins comprise a nickel-iron core covered by a copper sheath.

6. The incandescent lamp of claim 2 wherein the bead includes two substantially axially disposed holes, one of the pins being heat-sealed into each of the holes.

7. An incandescent lamp suitable for mounting to a substantially flat support surface, comprising:

a substantially dome-shaped substantially dome-shaped glass envelope having a single opening;

a filament mounted within the interior of the glass envelope;

a pair of metal contact pins supporting the filament and in electrical contact therewith, the pins being disposed partially enclosed within the envelope and partially outside of the envelope whereby the lamp can be energized through contacting the pins with a voltage source, and a glass bead comprising two integrally constructed concentrical cylinders, the first of said two cylinders being narrower than the second cylinder and dimensioned to fit into and heat sealed in the opening of the glass envelope, the second cylinder having a top and a bottom surface, the top surface abutting and being heat sealed to the glass envelope to hermetically close-off the same, the pins penetrating through the glass bead being heat-sealed thereinto, the bottom surface having a groove formed therein, said groove being dimensioned to accomodate the pins substantially flush with the bottom surface when said pins are bent outwardly, substantially at right angle to the longitudinal axis of the lamp.

8. The incandescent lamp of claim 7 where the glass envelope is substantially dome shaped.

9. The incandescent lamp of claim 7 where the pins comprise a nickel-iron core covered by a copper sheath.

10. The incandescent lamp of claim 7 where the bead includes two substantially axially disposed holes, one of the pins being heat-sealed into each of the holes.

* * * * *